US011283223B2

(12) United States Patent
Zebhauser et al.

(10) Patent No.: US 11,283,223 B2
(45) Date of Patent: Mar. 22, 2022

(54) CABLE CONNECTOR ARRANGEMENT, CABLE CONNECTOR AND PRESSING MEANS

(71) Applicant: Rosenberger Hochfrequenztechnik GmbH & Co. KG, Fridolfing (DE)

(72) Inventors: Martin Zebhauser, Laufen (DE); Gunnar Armbrecht, Tittmoning (DE); Thomas Mueller, Berchtesgaden (DE); Albert Eder, Ainring (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 48 days.

(21) Appl. No.: 16/718,798

(22) Filed: Dec. 18, 2019

(65) Prior Publication Data

US 2020/0203894 A1 Jun. 25, 2020

(30) Foreign Application Priority Data

Dec. 19, 2018 (DE) ..... 10 2018 132 823.0

(51) Int. Cl.

| | |
|---|---|
| ***H01R 13/58*** | (2006.01) |
| ***H01R 13/6474*** | (2011.01) |
| ***H01R 13/6592*** | (2011.01) |
| ***H01R 12/53*** | (2011.01) |
| *H01R 4/18* | (2006.01) |
| *H01R 9/05* | (2006.01) |

(52) U.S. Cl.

CPC ..... *H01R 13/6592* (2013.01); *H01R 12/53* (2013.01); *H01R 13/5816* (2013.01); *H01R 13/6474* (2013.01); *H01R 4/185* (2013.01); *H01R 9/0518* (2013.01)

(58) Field of Classification Search

None

See application file for complete search history.

(56) References Cited

U.S. PATENT DOCUMENTS

| | | | | |
|---|---|---|---|---|
| 6,261,121 | B1 * | 7/2001 | Harting | H01R 13/582 174/350 |
| 8,872,025 | B2 * | 10/2014 | Tamai | H01R 13/5216 174/60 |
| 10,587,080 | B2 * | 3/2020 | Wang | F21V 23/06 |
| 2005/0287873 | A1 | 12/2005 | Carroll et al. | |

FOREIGN PATENT DOCUMENTS

| | | | |
|---|---|---|---|
| DE | 43 18 800 | A1 | 12/1994 |
| EP | 2017-091855 | A | 5/2017 |
| JP | 2015-216015 | A | 12/2015 |

* cited by examiner

*Primary Examiner* — Felix O Figueroa

(74) *Attorney, Agent, or Firm* — Donald S. Showalter, Esq.; GrayRobinson, P.A.

(57) ABSTRACT

A cable connector arrangement includes a cable connector and an electrical cable with a plurality of individual lines each having a respective insulation and electrical conductor. The connector may include a front section configured for connection to a mating connector, a rear section in which the individual lines are surrounded by a cable sheath, and a central section. The electrical conductors of two individual lines have a first mutual distance in the rear section and a greater, second mutual distance in the front section with the mutual distance being increased in the central section. At least one pressing means in the central section may press at least the two individual lines together such that their insulations undergo mechanical deformation in a region of common contact.

19 Claims, 4 Drawing Sheets

CABLE CONNECTOR ARRANGEMENT, CABLE CONNECTOR AND PRESSING MEANS

CROSS REFERENCE TO RELATED APPLICATIONS

This application hereby claims priority under 35 U.S.C. § 119(a), priority is hereby claimed to German Patent Application No. 10 2018 132 823.0 which was filed in the German Patent Office on Dec. 19, 2018.

STATEMENT REGARDING FEDERALLY-SPONSORED RESEARCH OR DEVELOPMENT

Not Applicable

INCORPORATION BY REFERENCE

German Patent Application No. 10 2018 132 823.0 filed in the German Patent Office on Dec. 19, 2018 is expressly incorporated herein by reference in its entirety to form part of the present disclosure.

FIELD OF INVENTION

The invention relates to the field of electrical connections. More particularly, the present invention relates to cable connectors and cable connector arrangements useful for connecting electrical cables of the type having a plurality of individual lines each having an insulation and an electrical conductor.

BACKGROUND OF THE DISCLOSURE

As is known, a connector serves to produce an electrical connection to a complementary further connector (subsequently also referred to as mating connector). A cable connector may be, for example, a plug, a coupler or an adapter. The term "cable connector" used in the context of the invention is representative of all variants.

In particular, the automotive industry places high demands on the robustness and the safety of the connectors used in vehicles. A connector must thus sometimes withstand high loads, for example mechanical loads or thermal loads. The connectors must themselves retain their electrical properties within prescribed tolerance ranges under adverse environmental conditions in order to ensure permanently fault-free signal transmission. Particularly in the case of (partial) autonomous operation of vehicles and for assistance systems, ensuring safety is a priority.

Sometimes, for example during autonomous operation of a vehicle or during use of assistance systems, large amounts of data from a plurality of cameras, various sensors and navigation sources must be combined with one another and transmitted, usually in real time. The operation of a lot of devices, screens and cameras accordingly requires an efficient infrastructure in the vehicle electronics system. The demands on the connectors required for this and the electrical cables with respect to the necessary data rates are now very high for this reason.

In the context of a cable manufacturing process in which the individual electrical conductors of a cable are connected to the contact elements of a cable connector, it is generally necessary to distribute the individual lines of a multi-core cable in a transition region (subsequently also referred to as "central section" of a cable connector arrangement) in each case between the corresponding contact elements in a "front section" of the cable connector arrangement. While the individual lines within the electrical cable are encased by the cable sheath thereof and therefore generally guided through the cable in a central and tightly bearing manner (subsequently also referred to as "rear section" of the cable connector arrangement), spreading (what is known as changing the pitch) from the still small distance between the individual electrical conductors in the cable to a greater distance that corresponds to the distance between the contact elements of the cable connector is necessary in the central section of the cable connector arrangement. Corresponding guiding and distribution of individual lines of a twisted-pair cable in a connector housing is disclosed, for example, in generic US 2005/0287873 A1.

The problem, in particular when using the cable connector in high-frequency technology for transmitting high data rates, is that the signal path in the transition region or in the central section of the cable connector arrangement becomes more inductive due to the removal of the cable sheath. The corresponding change in impedance can in this section ultimately lead to undesired reflections of the HF signal, for which reason the required transmission standards, in particular for connectors in the automotive field, are generally able to be met only with great difficulty and also not for any desired types of connectors.

BRIEF SUMMARY OF THE INVENTION

The present invention is therefore based on the object of providing a cable connector arrangement that has an improved impedance profile. The invention is also based on the object of providing a cable connector with an improved impedance profile.

The invention is furthermore based on the object of providing a pressing means for a cable connector arrangement or for a cable connector, the use of which makes possible, in particular, an improved impedance profile of a cable connector arrangement or a cable connector.

Provision is made of a cable connector arrangement, having a cable connector and an electrical cable having a plurality of individual lines each having an insulation and an electrical conductor.

The electrical cable can have at least two individual lines. However, the electrical cable can also have more than two individual lines, for example three individual lines, four individual lines, five individual lines, six individual lines, seven individual lines, eight individual lines or even more individual lines.

The electrical cable is preferably formed as an unshielded cable. In principle, however, a shielded electrical cable can also be provided.

Above all, the electrical cable can be formed as a twisted-pair cable, that is to say as a cable with twisted core pairs. In principle, however, the electrical cable can be formed as desired, for example also as what is known as a parallel-pair cable, as a coaxial cable or as another cable.

An unshielded cable with twisted core pairs (what is known as an unshielded twisted-pair (UTP) cable) is particularly preferably provided.

The electrical conductor of the individual lines may be an individual wire or a Litz-wire, that is to say an electrical conductor consisting of thin individual wires. However, the type of electrical conductor is not dealt with in the context of the invention.

For electrical insulation of the electrical conductors of the individual lines from one another, the electrical conductors each have an encasing insulation or a respective insulating sheath.

The cable connector arrangement has a front section, which is configured for connection to a corresponding mating connector, a rear section, in which the individual lines are surrounded by a cable sheath, and an interposed central section.

The sections extend along the cable connector arrangement, preferably along a central axis of the cable connector arrangement. The central axis may be, for example, a longitudinal axis of the cable connector when the cable connector is formed as a straight cable connector. However, the central axis may also be the central axis of an angled cable connector ("angular connector"), which runs starting from a front interface of the cable connector for connection to a corresponding mating connector to a cable output of the cable connector. The front section adjoins the central section and the central section adjoins the rear section.

If the direction indication "front" is used in the context of the invention, this indication relates to the side of the cable connector arrangement or the end of the cable connector of the cable connector arrangement that faces the later mating connector (the "connector-side end"). The indication "rear" relates to a side of the cable connector arrangement or the end of the cable connector of the cable connector arrangement that faces the electrical cable (the "cable-side end"). In the below FIGS. 1 and 2, the left side of the cable connector is therefore located "at the front" and the right side of the cable connector is located "at the rear".

According to the invention, provision is made for the electrical conductors of two of the individual lines to have a first mutual nominal distance in the rear section and to have a second mutual distance in the front section, which second distance is greater than the first distance. The distance between the electrical conductors of the two individual lines increases in the central section in the direction of the front section.

The electrical cable thus still has its cable sheath in the rear section of the cable connector arrangement. The cable sheath of the cable is removed only from the central section of the cable connector arrangement. The individual lines of the electrical cable can therefore be accessible for individual further guidance from the central section.

Tolerances, according to which the distance between the electrical conductors in the rear section or within the cable sheath deviates from a provided nominal value (for example provided by a manufacturer), can be taken into account in the definition of the first mutual nominal distance, in particular since the distance between the electrical conductors within the cable sheath generally does not proceed constantly over the length of the electrical cable on account of the tolerances. In particular, the minimum possible distance within the electrical cable may be to be taken into account, including tolerances. The first distance may therefore be, for example, the "minimum distance".

The "minimum distance" of the conductors within the cable sheath is to be understood, in particular, as the minimum distance resulting in an orthogonal distance measurement between the electrical conductors that generally run in parallel through the electrical cable.

There may be provision for initially only two electrical conductors or only two individual lines to be taken into account for the determination of the first distance and the second distance, in particular an electrical conductor pair, which is configured for joint signal transmission. However, all of the electrical conductors or individual lines of the electrical cable can also be taken into account.

The invention is described below essentially based on two individual lines or the electrical conductors thereof. However, this is intended to serve substantially for better understanding of the basic principle of the invention and is not to be understood as restrictive. If reference is made below and above to "two individual lines" or "two individual conductors", this is also to be understood to include embodiments having more than two individual lines or having more than two individual conductors, in as far as this is not technically excluded.

According to the invention, at least one pressing means is provided in the central section and is formed to press together at least the two individual lines in such a way that the insulations thereof undergo a mechanical deformation in the region of a common contact area.

There may be provision for only some of the individual lines to be pressed together, for example only individual lines that are provided for signal transmission, in particular for symmetrical signal transmission. There may also be provision for only individual lines that are provided for signal transmission at a particularly high data rate (for example 100 Mbit/s or more) to be pressed together. For example, individual lines that are used only for the transmission of reference signals, signals at low frequencies and/or electrical supply signals can be guided regularly, that is to say not pressed together.

Preferably, however, all of the individual lines of the electrical cable are pressed together by the at least one pressing means.

By pressing the at least two individual lines by means of the at least one pressing means, common contact areas are produced at the outer sheaths of the insulations of the individual lines pressed together, said contact areas generally increasing in size as the pressing pressure increases.

By way of the inventive use of the at least one pressing means, impedance matching, in particular in the central section of the cable connector arrangement, can advantageously take place, according to which the impedance value in the transition region between the cable and the connector can be optimized.

According to the invention, a constant impedance over the entire cable connector arrangement can preferably be ensured.

By minimizing the "untwisted" region, the cable connector arrangement can have an improved EMC behavior.

Reflections in the signal transmission can advantageously be prevented despite the generally necessary distance or pitch matching of the electrical conductors of the electrical cable upon transition to the cable connector or to the front region.

According to the invention, it can be ensured that the signal path at least along the pinch-seal region or along the region in which the at least one pressing means presses together the individual lines is again more capacitive and in the ideal case matched, for example to an impedance of 100 ohms.

In the ideal case, the transition region or the central section of the cable connector arrangement can be shortened from an impedance profile view.

In one embodiment of the invention, provision can be made for the at least one pressing means to be formed to press together the two individual lines in such a way that the insulations thereof have an oval cross section.

In the ideal case, that is to say neglecting tolerances, the cross section of the individual lines runs in a circular manner (insulation and electrical conductor) without the effect of external forces. The cross section of the individual lines can be deformed proceeding from the (in the ideal case) circular shape by way of the pressing according to the invention.

For example, the cross section of the individual lines can also run in an elliptical manner due to the pressing.

It is possible to produce a cross section of the individual lines in which a ratio of width to length of 0.99 or less, for example 0.95 and less, 0.90 and less, 0.85 and less, 0.80 and less, 0.75 and less or even less is produced.

The at least two individual lines can be pinched together without, however, mechanically damaging the insulation and/or the electrical conductors running therein.

In one embodiment of the invention, provision can be made for the at least one pressing means to be formed to press together the two individual lines in such a way that a third mutual distance results between the electrical conductors thereof, which third distance is smaller than would be the case in the event of the individual lines being placed against one another in a force-free manner.

According to the invention, the individual lines in the region of the central section influenced by the pressing means are guided not only in contact or lying closely against one another. A minimum distance between electrical conductors only running in contact can be further reduced by way of the pressing according to the invention.

The distance between the center points of the electrical conductors of the individual lines pressed together can preferably be smaller than in the case of minimum tolerance situation (according to manufacturer specification) of the individual lines.

In one embodiment of the invention, provision can be made for the at least one pressing means to be formed to press together the two individual lines in such a way that a third mutual distance results between the electrical conductors thereof, which third distance is smaller than the first distance.

Provision may be made, for example, for the individual lines to be guided and to be pinched against one another by at least one pressing means in the transition region between the cable and the cable connector, that is to say in the central section of the cable connector arrangement, so that the distance (pitch) of the electrical conductors of the individual lines is reduced compared to the distance or pitch in the electrical cable.

In one embodiment of the invention, provision may furthermore be made for the at least one pressing means to be formed to press together the two individual lines in such a way that the impedance in the central section or at least in a region of the central section covered by the at least one pressing means is 85 ohms to 115 ohms, preferably 90 ohms to 110 ohms, particularly preferably 95 ohms to 105 ohms and very particularly preferably 100 ohms or at least approximately 100 ohms and/or is matched to the impedance in the front section and in the rear section.

Due to the pressing means, the impedance in the central section can be matched, in particular, to the extent that a sudden change in impedance between the front section and the rear section is prevented or at least reduced.

For example, the impedance in the central section can be matched so that it corresponds to the impedance in the rear section, in the front section and/or in the electrical cable or at least does not deviate therefrom by more than 0.1%, 0.2%, 0.5%, 1.0%, 1.5%, 5.0%, 10.0%, 25.0% or 50.0%.

The transmission standards for electrical cables and connectors in the automotive field generally require an impedance of 100 ohms+/−5%. While these requirements for the individual electrical cable and for the cable connector can each be met, there may be a deviation from said requirement on account of the removal of the cable sheath in the transition region or in the central section. By way of the impedance matching by means of the at least one pressing means, the requirements of the impedance can preferably also be met in the central section.

In one embodiment of the invention, provision may also be made for the material of the at least one pressing means to have a permittivity that corresponds or at least approximately corresponds to the permittivity of the cable sheath, in particular deviates from the permittivity of the cable sheath by less than 10%, preferably deviates from the permittivity of the cable sheath by less than 5%, particularly preferably deviates from the permittivity of the cable sheath by less than 1% and very particularly preferably deviates from the permittivity of the cable sheath by less than 0.5%.

The at least one pressing means is preferably formed as a plastic part. However, the at least one pressing means can also be formed from another material, for example from metal. A multi-part configuration possibly consisting of several materials is also possible.

The at least one pressing means is preferably formed from the same dielectric material from which the cable sheath also consists or at least from a similar material.

In particular, when the dielectric constants or the permittivities of the cable sheath and of the at least one pressing means at least substantially correspond, the change in impedance in the central section that may essentially be caused by the removal of the cable sheath can at least partly, preferably completely, be compensated.

There may also be provision for the material of the at least one pressing means or the permittivity thereof to be selected in a targeted manner so that the impedance in the central section can be set or prescribed in a targeted manner.

In a preferred embodiment of the invention, provision may be made for the cable connector to have a connector housing, along which at least the front section extends.

There may be provision for the connector housing to have a front section, which forms the front section of the cable connector arrangement.

The connector housing can be configured in the region of the front section, in particular, for connection to a corresponding mating connector.

In a preferred embodiment of the invention, provision may furthermore be made for the central section to extend along the connector housing and for the pressing means to be arranged in the connector housing.

There may be provision for the connector housing to have a section following along a central axis of the connector housing on the front section thereof, a central or a rear section, which forms the central section of the cable connector arrangement.

In one embodiment of the invention, provision may furthermore be made for the at least one pressing means to be formed in one piece with the connector housing, preferably to be formed as a rib that projects into the interior of the connector housing.

In particular, a V-shaped, U-shaped and/or part-ring-shaped rib may be provided, which may at least partly receive the at least two individual lines in it and press them together.

For example, one individual rib may be provided. However, a plurality of ribs or pressing means may also be provided, for example two, three, four or even more ribs, which are arranged along the central axis, preferably along the longitudinal axis of the connector housing, distributed over the central section.

The at least one pressing means may also be formed in the manner of pins, plates etc. that project into the interior of the connector housing.

In one embodiment of the invention, provision may furthermore be made for the at least one pressing means to be formed independently of the connector housing, preferably to be formed as a clamp.

Provision may be made, for example, of a V-shaped, U-shaped and/or part-ring-shaped clamp.

Provision may also be made of a clamping solution in the form of a cable tie.

In principle, a combination of one-part pressing means and pressing means formed independently of the connector housing can also be provided. For example, provision may be made for one or more pressing means to be formed in one piece with the connector housing, for example as a rib or ribs, and for one or more further pressing means to be formed as clamps formed independently of the connector housing or other pressing means.

For example, one clamp may be provided. However, a plurality of clamps may also be provided, for example two, three, four or even more clamps, which are arranged distributed over the central section of the cable connector arrangement.

In principle, any desired number of pressing means in any desired configuration and distribution can be provided to press together the at least two individual lines. The number of pressing means can be selected by a person skilled in the art depending on the axial extent of the central section, in particular with the aim of guiding the at least two individual lines as completely as possible and in a manner sufficiently pressed against one another through the central section.

Provision is preferably made of two pressing means, which, in one piece with the connector housing offset axially along the central axis of the connector housing, are formed as ribs that project into the interior of the connector housing.

In one embodiment of the invention, provision can be made for the at least one pressing means to be formed to guide the two individual lines through the central section as centrally as possible along the central axis of the connector housing.

The at least two individual lines can be guided in particular in a manner spaced apart as far as possible from the inner faces of the connector housing, that is to say—in so far as it is technically possible—run in the center of the connector housing.

On account of the guidance of the individual lines within the connector housing in a manner as centered as possible (as close as possible to the connector center or on the central axis of the cable connector), the distance between the electrical conductors of the electrical cable of adjoining objects, for example adjoining conductive vehicle body parts, is increased and as a result the risk of short circuits in the case of mechanical damage to the cable connector is reduced.

In a preferred embodiment of the invention, provision may be made for the rear section to extend along the connector housing.

There may be provision for the connector housing to have a rear section, which forms the rear section of the cable connector arrangement.

The connector housing may be formed in the region of the rear section, in particular, to receive the electrical cable.

In a particularly preferred embodiment, provision may be made for the connector housing to have a rear section, into which the electrical cable is inserted, to have a front section, which is configured for connection to a corresponding mating connector, and to have a central section, which extends between the rear section and front section along the central axis of the connector housing. In this variant of the invention, the front section of the connector housing preferably forms the front section of the cable connector arrangement, the central section of the connector housing preferably forms the central section of the cable connector arrangement, and the rear section of the connector housing preferably forms the rear section of the cable connector arrangement.

In one embodiment of the invention, provision can furthermore be made for the connector housing and/or the at least one pressing means to be formed to prevent or at least to minimize air inclusions in the central section.

As a result thereof, the impedance profile, in particular in the central section, can also be improved, for example, homogenized.

In one embodiment of the invention, provision can also be made for the individual lines at least in the central section to be encapsulated with an elastic filling material.

In a preferred variant, the individual lines within the connector housing are encapsulated with the elastic filling material.

In particular, air inclusions can be prevented thereby.

The individual lines can, for example, also be placed in a defined forced position by the encapsulation.

It may be advantageous to use for the filling material a similar or preferably identical material to that from which the cable sheath of the electrical cable also is made. In particular, provision may be made for the permittivity of the filling material to at least approximately correspond to the permittivity of the cable sheath.

A filling material whose permittivity is greater than the permittivity of air is preferably selected.

In principle, a non-elastic filling material can also be used. However, an elastic filling material is particularly preferred.

By selecting the filling material or the electrical properties thereof, in particular dielectric properties, the impedance in the central section can be controlled in a targeted manner.

In principle, the connector housing can be formed from a dielectric material, in particular from a plastic. However, the connector housing can also have an electrically conductive outer conductor in order to further improve the impedance transition.

In one embodiment of the invention, provision may be made for the connector housing to be of multi-part form and to have at least one lower shell and one upper shell.

In particular, the lower shell may be the part of the connector housing in which the electrical cable is received and which also has the at least one pressing means, which is preferably formed in one piece with the lower shell.

The upper shell may preferably be a cover element that is able to be connected to the lower shell. The upper shell may be able to be latched to the lower shell. For example, latching means, for example latching hooks and latching lugs, can be provided for this purpose on the lower shell and/or the upper shell.

The upper shell may have mechanical coding features for the connection to the mating connector, for example in order to be able to connect the cable connector only to a specific mating connector type and possibly also only in one or more provided orientations.

The upper shell of the connector housing can be formed to fix the individual lines, the electrical cable, the contact elements and/or the at least one pressing means in the lower shell or to at least secure against falling out when the upper shell is placed onto the lower shell.

Provision can also be made for both the upper shell and the lower shell to have pressing means formed in one piece, for example ribs that engage into one another, in order to press together the at least two individual lines when the upper shell is placed onto the lower shell.

In one embodiment of the invention, provision can be made for the connector housing to have at least one fastening means for axial fastening of the cable sheath, in particular for strain relief of the cable.

The fastening means can preferably be arranged in the rear section of the connector housing.

Provision can be made for the electrical cable or the cable sheath thereof to be fixed on the rear section of the connector housing, in particular to be axially fixed. The electrical cable or the cable sheath thereof can also optionally be radially fixed.

For example, one or more claws can be provided, which at least partly penetrate into the cable sheath and therefore prevent the cable undesirably coming out of the cable connector and/or the electrical cable undesirably rotating in the cable connector.

A force-fitting fastening of the electrical cable in the rear section of the connector housing can also be provided.

In one embodiment of the invention, a plurality of contact elements that are electrically connected, preferably crimped, to the electrical conductors of the individual lines can be provided in the connector housing.

The contact elements are preferably arranged in the front section of the connector housing.

The contact elements may be, for example, pin contacts and/or socket contacts.

In principle, any desired number of contact elements can be provided in the connector housing, for example two contact elements, three contact elements, four contact elements, five contact elements, six contact elements, seven contact elements, eight contact elements or even more contact elements.

The number of contact elements can preferably correspond to the number of individual lines. However, provision can also be made for the cable connector to have more electrical contact elements than the electrical cable has individual lines. In this case, individual contact elements can possibly also not be connected to an individual line and/or a plurality of contact elements can be connected to a joint individual line. Furthermore, provision can also be made for the number of individual lines of the electrical cable to exceed the number of contact elements of the cable connector. In this case, individual lines of the electrical cable can possibly not be connected to a contact element and/or a plurality of individual lines can be connected to a joint contact element.

In one embodiment of the invention, provision can be made, in particular, for the front section of the connector housing to extend proceeding from a front end of the connector housing facing the mating connector up to a rear end of the contact elements facing the electrical cable.

Therefore, provision can be made, for example, for the front section to have the contact elements for the connections to the corresponding mating connector.

The central section can extend proceeding from the rear end of the contact elements facing the electrical cable up to the rear section of the connector housing from which the cable sheath of the electrical cable is also stripped.

In one embodiment of the invention, at least one separating means can be provided in the front section and/or at least in a front region of the central section facing the front section in order to separate the contact elements and/or the individual lines from one another.

The at least one separating means can preferably be arranged in the connector housing, in particular in the front section of the connector housing and/or at least in a front region of the central section of the connector housing facing the front section of the connector housing.

The separating means may be, in particular, a dielectric separating means, for example a plastic part. The separating means is preferably formed as a separating wall between individual contact elements or groups of contact elements. The at least one separating means can be formed to optimize the impedance profile in the front section and/or in the front region of the central section or to match said impedance profile to the standard required. The pressing according to the invention by means of the at least one pressing means can be particularly advantageous along the axial region of the central section, since neither a separating means nor the cable sheath run there.

Provision can preferably be made for the central section of the connector housing, in particular a section in the connector housing in which the individual lines of the electrical cable are insulated from the cable sheath and are not separated from one another by other components, in particular the separating means (for example a plastic separating wall), to be shortened as much as possible but without the bending radii prescribed for the respective electrical cable or for the respective individual lines being undershot.

In this way, the critical central section can be shortened axially in such a way that the impedance value changed due to the removal of the cable sheath is not able to be reached during signal transmission or the impedance matching according to the invention is simplified by the at least one pressing means.

In particular, when using a connector housing that is of multi-part form, for example consisting of a lower shell and an upper shell, the cable connector can be formed as a modular cable connector. For example, the lower shell can be identical for various designs of the cable connector and can be adjusted to a defined mating connector type by using various upper shells.

The invention also relates to a cable connector for connection to an electrical cable having a plurality of individual lines each having an insulation and an electrical conductor. The cable connector comprises a front section, which is configured for connection to a corresponding mating connector, a rear section, in which the individual lines are surrounded by a cable sheath and an interposed central section. The electrical conductors of two of the individual lines have a first mutual nominal distance in the rear section and have a second mutual distance in the front section, which second distance is greater than the first distance. The distance between the electrical conductors of the two individual lines increases in the central section in the direction of the front section.

According to the invention, at least one pressing means is provided for the cable connector in the central section and is formed to press together at least the two individual lines in such a way that the insulations thereof undergo a mechanical deformation in the region of a common contact area.

According to the invention, impedance control can be provided in the cable output of the cable connector.

According to the invention, the electrical matching, in particular in the central section, and therefore also a return loss can be improved.

In a preferred embodiment, the cable connector has a connector housing in which the rear section, the central section and/or the front section is/are formed.

In this preferred variant of the cable connector, the connector housing can have a rear section, into which an electrical cable is able to be inserted, a front section for connection to a corresponding mating connector and a central section, which extends between the rear section and the front section along a central axis of the connector housing. The central section of the connector housing can be formed to guide a plurality of individual lines of the electrical cable, which proceeding from the rear section do not have a cable sheath, to the front section of the connector housing, wherein each individual line has an insulation and an electrical conductor.

By pressing the individual lines or by concomitantly wedging in the electrical cable or the individual lines thereof, in the central section the impedance can be matched with minimum fluctuations up to the contact elements or to the front section of the connector housing.

The invention furthermore relates to a pressing means for the cable connector arrangement described above and below or for the cable connector described above and below.

The individual lines can be guided in a defined manner in the central section based on the pressing means in a technically simple way.

Provision can be made for the at least one pressing means to follow in cross section the contour of the individual lines in as optimum a manner as possible in order to enclose the individual lines as completely as possible.

Since only the at least one pressing means is required for the impedance matching, a cable connector that is comparatively cost-effective to produce with good properties for high-frequency technology can be provided. The installation of the cable connector or the assembly of the electrical cable with the cable connector can be simplified in accordance with the invention.

For defined impedance matching in the central section by the at least one pressing means, calculations, simulations and/or measurement series can be carried out.

The invention is not restricted to a specific design of a cable connector or to a specific electrical cable. However, the invention is suitable, in particular, for electrical cables or for cable connectors for high-frequency technology, in particular for use in vehicles.

A cable connector according to the invention may be formed, for example, as a PL connector, BNC connector, TNC connector, SMBA (FAKRA) connector, N connector, 7-16 connector, SMA connector, SMB connector, SMS connector, SMC connector, SMP connector, BMS connector, HFM connector, HSD connector, H-MTD connector, BMK connector, Mini-Coax connector or Makax connector.

The cable connector according to the invention can particularly advantageously be used within a vehicle, in particular a motor vehicle. Possible fields of use are autonomous driving, driver assistance systems, navigation systems, infotainment systems, rear seat entertainment systems, internet connections and wireless gigabit (IEEE 802.11ad standard). Possible applications relate to high-resolution cameras, for example 4K and 8K cameras, sensor systems, onboard computers, high-resolution screens, high-resolution dashboards, 3D navigation devices and mobile radios.

Very particularly, the invention may be suitable for use with the Rosenberger MTD (modular twisted-paired data) connector system, a transmission system for sheathed twisted-pair lines for ethernet applications. A further likewise particularly advantageous use of the invention may also relate to an AMEC (automotive modular ethernet connection) connector system.

A possible use in the context of an ethernet application of a cable connector arrangement according to the invention may relate, in particular, to data transmissions at 100 Mbit/s to one Gbit/s or more. In the context of the invention, chip-to-chip applications can also be provided.

Features that have already been described in conjunction with the cable connector arrangement according to the invention can also advantageously be transferred to the cable connector according to the invention and to the pressing means according to the invention, and vice versa. Furthermore, advantages that have already been described in conjunction with the cable connector arrangement according to the invention can also be understood as relating to the cable connector according to the invention and to the pressing means according to the invention, and vice versa.

It should additionally be pointed out that terms such as "comprising", "including" or "having" do not exclude other features or steps. Furthermore, terms such as "a(n)" or "the" indicating steps or features in the singular do not exclude a plurality of features or steps—and vice versa.

Exemplary embodiments of the invention will be described in more detail below on the basis of the drawing.

The Figs. each show preferred exemplary embodiments, in which individual features of the present invention are illustrated in combination with one another. Features of an exemplary embodiment are also implementable separately from the other features of the same exemplary embodiment, and may accordingly be readily combined by a person skilled in the art with features of other exemplary embodiments in order to form further meaningful combinations and sub-combinations.

In the Figs., functionally identical elements are denoted by the same reference numerals.

DETAILED DESCRIPTIONS OF PREFERRED EMBODIMENTS

Figure 1:
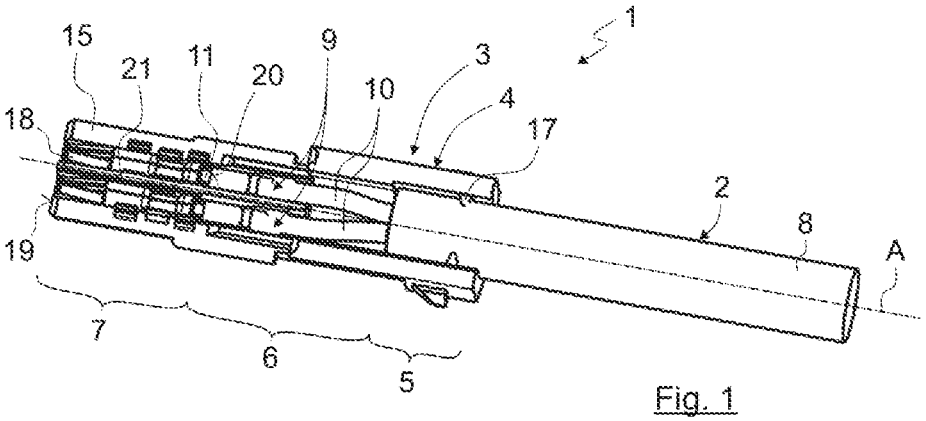
Fig. 1 PRIOR ART
FIG. 1 shows schematically, a plan view of a cable connector arrangement, comprising an electrical cable and a cable connector having a connector housing according to the prior art.

FIG. 1 illustrates schematically a cable connector arrangement 1 according to the prior art. The cable connector arrangement 1 comprises an electrical cable 2 and a cable connector 3 having a connector housing 4.

The electrical cable 2 is formed in the present case, for example, as a two-core, unshielded twisted-pair cable (UTP cable). In principle, however, the invention may be able to be used for any electrical cable, for example even for shielded electrical cables.

The connector housing 4 has a rear section 5, into which the electrical cable 2 is inserted, a front section 7 for connection to a corresponding mating connector (not illustrated), and a central section 6, which extends between the rear section 5 and front section 7 along a longitudinal axis A of the connector housing 4.

Beginning from the central section 6, the electrical cable 2 is freed of its cable sheath 8. The central section 6 is formed to guide a plurality of individual lines 9, in the present case two individual lines 9, of the electrical cable 2 from the rear section 5 to the front section 7, wherein each individual line 9 has an insulation 10 and an electrical conductor 11 (cf. for example FIG. 3).

In the cable connector 3 according to the prior art illustrated in FIG. 1, it is problematic that the signal path becomes more inductive in the central section 6 on account of the removed cable sheath 8 and the required spreading or what is known as changing the pitch of the individual lines 9 (that is to say the change in the distance between the individual lines 9 with respect to one another). As a result, a change in impedance is caused, which can lead to undesired reflections of the HF signal.

Figure 7:
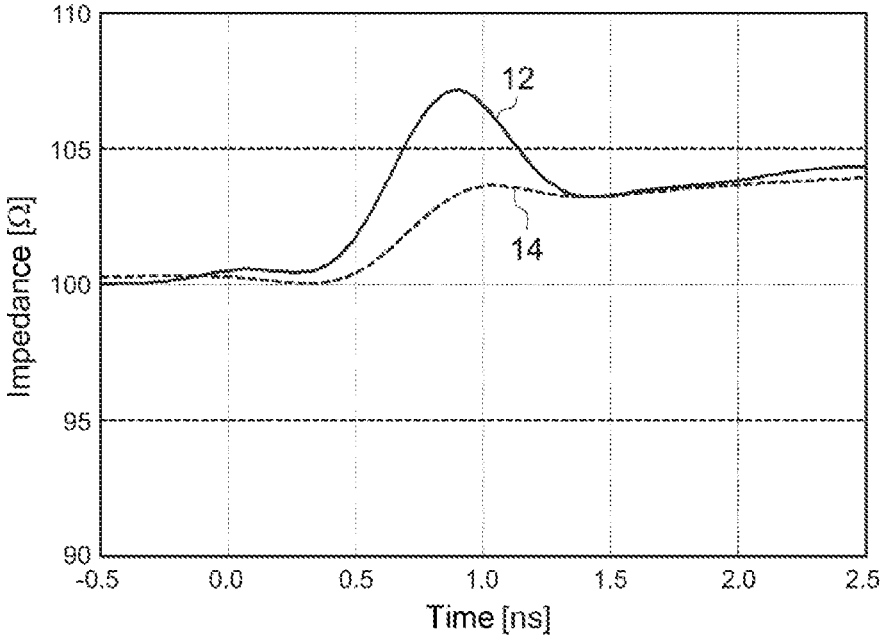
FIG. 7 shows schematically, exemplary time domain reflector diagrams of a cable connector arrangement according to the prior art and a cable connector arrangement according to the invention.

In FIG. 7, for illustration, two exemplary time domain reflector diagrams are illustrated. The curve provided with the reference sign 12 shows the curve profile of a cable connector arrangement 1 according to the prior art. It can be identified that the impedance of the cable connector arrangement 1 according to the prior art does not meet the transmission standard generally required in the automotive field of 100 ohms+/−5%.

Figure 2:
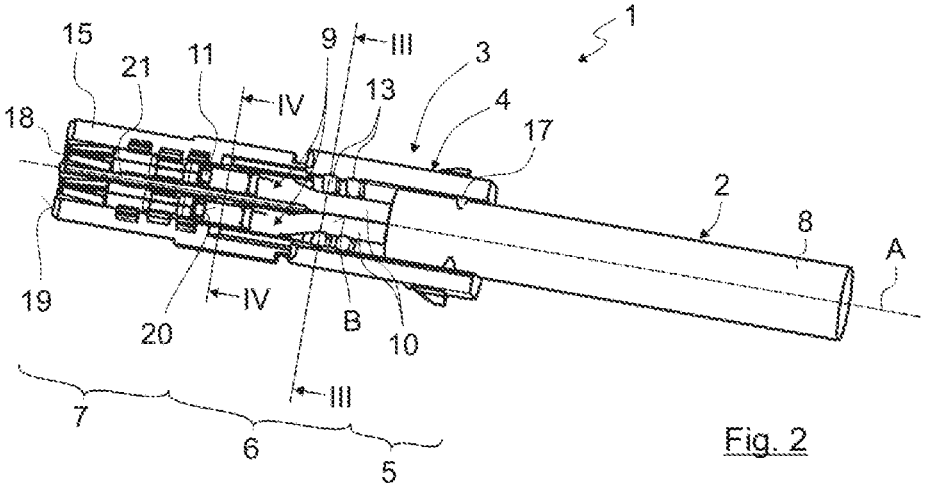
FIG. 2 shows schematically, a plan view of a cable connector arrangement according to the invention, comprising an electrical cable and a cable connector having a connector housing.

FIG. 2 illustrates a cable connector arrangement 1 according to the invention. The following text deals substantially with the differences between the cable connector arrangement 1 according to the invention and the known cable connector arrangement 1 of FIG. 1.

Figure 3:
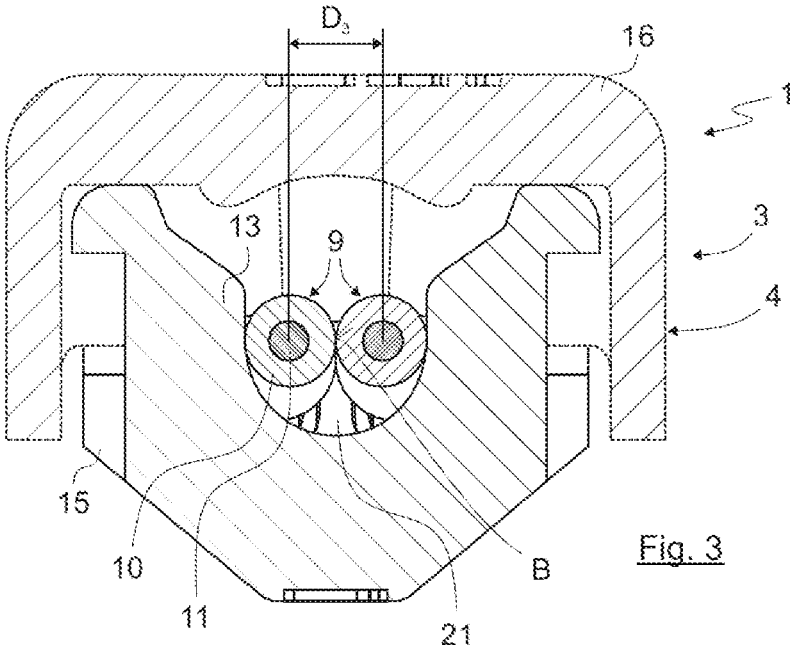
FIG. 3 shows schematically, a cross section through the cable connector of FIG. 2 according to section line III.
Figure 6:
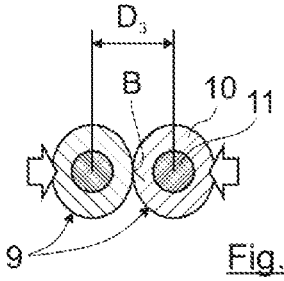
FIG. 6 shows schematically, a detail illustration of parallel guidance of two individual lines pressed together in cross section.

According to the invention, at least one pressing means 13 is provided in the central section 6 and is formed to press together at least two of the individual lines 9, in the present case both individual lines 9, in such a way that the insulations 10 thereof undergo a mechanical deformation in the region of a common contact area B (cf. in particular FIG. 3 and FIG. 6).

As a result, the impedance in the transition region or in the central section 6 can be influenced in a targeted manner and therefore controlled. The required standards, for example the aforementioned exemplary automotive standard of 100 ohms+/−5%, is able to be met in accordance with the invention by way of technically simple measures. For illustration, in FIG. 7, a curve, which is provided with the reference sign 14, of a cable connector arrangement 1 according to the invention is illustrated by way of example.

Figure 4:
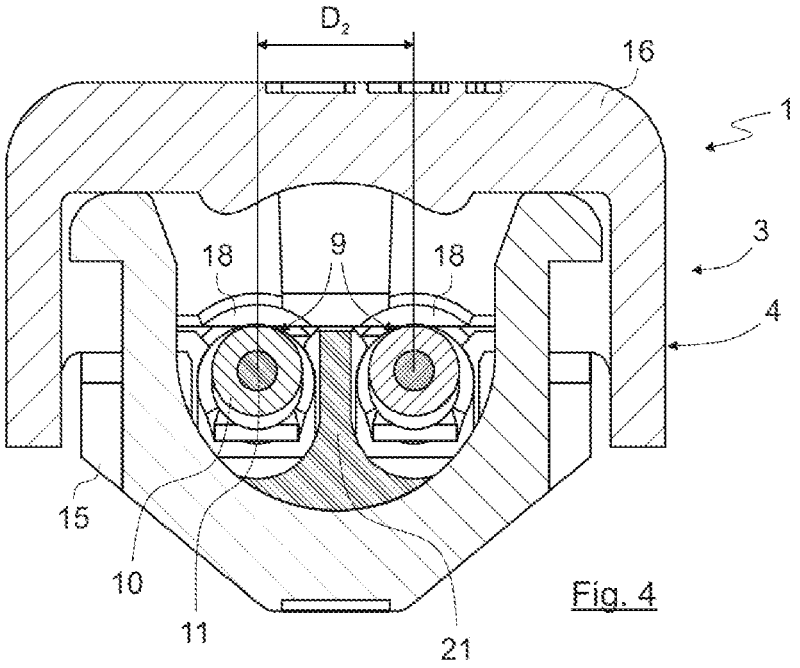
FIG. 4 shows schematically, a cross section through the cable connector of FIG. 2 according to section line IV.

The cable connector arrangement 1 illustrated in FIG. 2 is a preferred embodiment of the invention. In principle, in the context of the invention, provision can be made for the cable connector arrangement 1 to comprise the front section 7, which is configured for connection to a corresponding mating connector, the rear section 5, in which the individual lines 9 are still surrounded by a cable sheath 8, and the interposed central section 6. Therefore, the front section 7, the central section 6 and/or the rear section 5 do not necessarily have to correspond to a front section, central section or rear section of the cable connector 3. In the context of the invention, it is only essential that the electrical conductors 11 of two of the individual lines 9 have a first mutual nominal distance $D_1$ in the rear section 5 of the cable connector arrangement (cf. for example FIG. 5) and have a second mutual distance $D_2$ in the front section of the cable connector arrangement 1 (cf. for example FIG. 4), which second distance is greater than the first distance $D_1$, wherein the distance between the electrical conductors 11 of the two individual lines 9 in the central section 6 of the cable connector arrangement increases in the direction of the front section of the cable connector arrangement 1.

Figure 8:
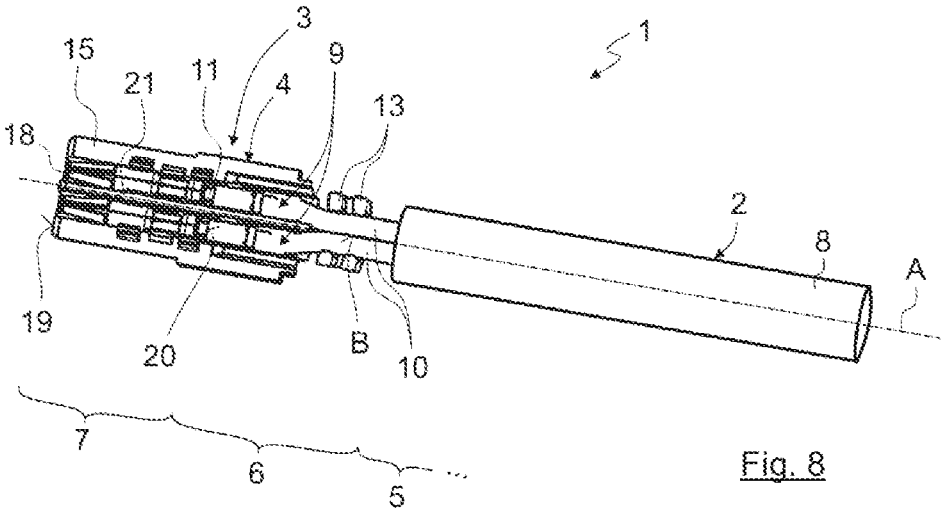
FIG. 8 shows schematically, a plan view of a further cable connector arrangement according to the invention, comprising an electrical cable and a cable connector having a connector housing.

FIG. 8 is intended to serve for further illustration of this basic principle. FIG. 8 shows a cable connector arrangement 1, in which the electrical cable 2 and the pressing means 13 are not received in the connector housing 4. Only the front section 7 and a front region of the central section 6 extend along the connector housing 4.

At this point, it should furthermore be mentioned that the invention may also be suitable for use with angular cable connectors. However, only cable connectors 3 that run in a straight line are illustrated In the exemplary embodiments, for simplification purposes.

Figure 5:
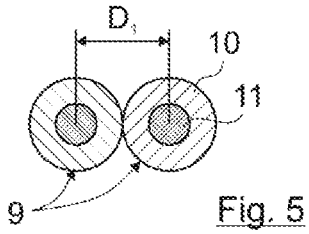
FIG. 5 shows schematically, a detail illustration of force-free, parallel guidance of two individual lines in cross section.

The principle of pressing together the individual lines 9 is further illustrated based on FIGS. 5 and 6.

FIG. 5 shows in cross section two individual lines 9 guided in parallel in a force-free state, with the result that they only bear tightly against one another and have a nominal distance $D_1$ between the center points of the electrical conductors 11 thereof.

FIG. 6 shows the individual lines 9 of FIG. 5 when they are pressed together by the at least one pressing means 13 (illustrated by two arrows). By pressing together the individual lines 9, a common contact area B between the individual lines 9 is formed, which causes a mechanical deformation of the insulations 10. The individual lines 9 are generally pressed together in such a way that the insulations 10 thereof have an oval cross section after the pressing, proceeding from the—at least in the ideal and tolerance-free case—round cross section, as illustrated in FIG. 5 in the unloaded state.

The pressing means 13 can preferably be formed to press together the at least two individual lines 9 in such a way that the distance $D_3$ between the center points of the electrical conductors 11 thereof is smaller than is the case in the force-free case of FIG. 5.

In particular, provision can also be made for the at least one pressing means 13 to be formed to press together the at least two individual lines 9 in such a way that the distance $D_3$ between the center points of the electrical conductors 11 thereof is smaller than the minimum distance between the electrical conductors 11 thereof within the cable sheath 8 of the cable 2.

Finally, provision can be made, in particular, for the at least one pressing means 13 to be formed to press together the at least two individual lines 9 in such a way that the impedance in the central section 6 or at least in a region of the central section 6 covered by the at least one pressing means 13 is 85 ohms to 115 ohms, preferably 90 ohms to 110 ohms, particularly preferably 95 ohms to 105 ohms and very particularly preferably 100 ohms or is sufficiently matched to the impedance in the front section 7 and in the rear section 5.

In the context of controlled impedance matching, provision can also be made for the material of the at least one pressing means 13 to have a permittivity that corresponds or at least approximately corresponds to the permittivity of the cable sheath 8. For example, the at least one pressing means 13 and the cable sheath 8 can be formed from the same dielectric material.

Provision can be made for the at least one pressing means 13 to be formed in one piece with the connector housing 4, preferably as a rib that projects into the interior of the connector housing 4. This is the case in the exemplary embodiments. Alternatively or in addition, however, provision may also be made for the at least one pressing means 13 to be formed independently of the connector housing 4, preferably to be formed as a clamp. In this case, the at least one pressing means 13 does not even have to be arranged in the connector housing 4, as is illustrated in FIG. 8.

Any number of pressing means 13 may be provided. In the exemplary embodiment, two pressing means 13 are provided in the form of ribs.

As is also the case in the exemplary embodiment, provision can be made for the at least one pressing means 13 to be formed to guide the at least two individual lines 9 through the central section 6 as centrally as possible along the longitudinal axis A of the connector housing 4. As a result thereof, the individual lines 9 can be guided as far away as possible from the inner walls of the connector housing 4, which can reduce the risk of a short circuit between one or more electrical conductors 11 and conductive components surrounding the cable connector 3 in the event of severe mechanical damage to the cable connector 3.

In principle, provision can be made for the connector housing 4 and/or the at least one pressing means 13 to be formed to prevent or at least to minimize air inclusions in the central section 6. However, this is not substantially important.

Provision can be made for the individual lines 9 at least in the central section 6, particularly preferably within the connector housing 4, to be encapsulated with a filling material, for example with a filling material that has a permittivity that corresponds or at least approximately corresponds to the permittivity of the cable sheath 8. An elastic filling material is preferably provided.

In the exemplary embodiment, provision is made for the connector housing 4 to be of multi-part form and to have at least one lower shell 15 and one upper shell 16. This can be seen particularly well based on the sectional illustrations in accordance with FIGS. 3 and 4 along the section lines III and IV illustrated in FIG. 2. In FIGS. 1 and 2, only the respective lower shells 15 are illustrated; FIG. 3 shows the upper shell using dashed lines.

The upper shell 16 may be formed in the manner of a cover part and can fix or at least cover the components housed in the lower shell 15, in particular the individual lines 9 and the electrical cable 2 when the upper shell 16 is placed on the lower shell 15. Latching means can be provided to latch together the upper shell 16 and the lower shell 15. The upper shell 16 can have a mechanical coding feature to enable contact-connection only with a specific mating connector and possibly also only in one or more defined orientations. In particular based on the two-part configuration, the cable connector 3 can be of modular design, according to which, for example, the lower shell 15 can be identical for various forms of the cable connector 3 and may be able to be combined with various upper shells 16 for connection to various mating connectors.

Provision can be made for the connector housing 4 to have in the rear section 5 at least one fastening means, in the exemplary embodiment clamps 17, for the axial and/or radial fastening of the cable sheath 8, in particular for strain relief of the cable 2.

A plurality of contact elements 18 can be provided in the front section 7 of the connector housing 4, said plurality of contact elements being electrically connected, preferably crimped, to the electrical conductors 11 of the individual lines 9. In the exemplary embodiments, two contact elements 18 are provided in a manner corresponding to the number of individual lines 9. In principle, however, the number of contact elements 18 and the number of individual lines 9 do not have to correspond and may each be different.

The front section 7 of the connector housing 4 can extend proceeding from a front end 19 of the connector housing 4 facing the mating connector up to a rear end 20 of the contact elements 18 facing the electrical cable 2.

Provision can be made, in particular, for the connector housing 4 to have at least one separating means 21 in the front section 7 and/or at least in a front region of the central section 6 facing the front section 7 in order to separate the contact elements 18 and/or the individual lines 9 from one another. In the present case, the separating means 21 is formed as a separating wall, which is formed in one piece with the lower shell 15 of the connector housing 4 and separates the contact elements 18 in the front section 7 of the connector housing 4 and the individual lines 9 in the front region of the central section 6 from one another. In particular, provision can advantageously be made for the at least one pressing means 13 to be arranged and formed in the central section 6 in such a way that the individual lines 9 are sufficiently pressed together at least in this region in order to achieve desired impedance matching.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. A cable connector arrangement, comprising:

an electrical cable and a cable connector connected to the electrical cable, the cable connector arrangement including a front section, a rear section and a central section, the front section, the rear section and the central section each extending along a longitudinal axis of the cable connector, the central section being interposed longitudinally between the front section and the rear front section, the electrical cable having at least two individual lines, each of the individual lines having a respective insulation and a respective electrical conductor, the front section being configured for connection to a mating connector; the electrical cable further including a cable sheath; the cable sheath surrounding the individual lines in the rear section, the cable sheath being not present in the front section, the cable sheath being not present in the central section; the respective electrical conductors of two of the individual lines having respective cross-sectional center points which are mutually spaced from one another by a mutual distance; the mutual distance being a first mutual nominal distance, in the rear section, the mutual distance in the front section, being a second mutual distance, the second mutual distance being greater than the first mutual nominal distance; the central section having at least one pressing means which influences an impedance of the cable connector by pressing the two individual lines against one another to compress the respective insulations of both of the two individual lines causing the respective insulations of both of the two individual lines to be mechanically deformed in an area in which the respective insulations of the two individual lines are in common contact with one another, the area being located within the central section, the respective insulations of the two individual lines being mechanically deformed in a way which results in the mutual distance in the area being a third mutual distance which is less than the first mutual nominal distance.

2. A cable connector arrangement as claimed in claim 1, wherein the respective insulations of the two individual lines have an oval cross section after being mechanically deformed.

3. A cable connector arrangement as claimed in claim 1, wherein the third mutual distance is smaller than would be the case in the event of the two individual lines being placed against one another in a force-free manner.

4. A cable connector arrangement as claimed in claim 1, wherein the at least one pressing means presses the two individual lines together in such a way that an impedance in a region of the central section is 85 ohms to 115 ohms.

5. A cable connector arrangement as claimed in claim 1, wherein the at least one pressing means is of a material which has a permittivity that at least approximately corresponds to a permittivity of the cable sheath.

6. A cable connector arrangement as claimed in claim 1, wherein the cable connector further includes a connector housing along which at least the front section extends.

7. A cable connector arrangement as claimed in claim 6, wherein the central section extends along the connector housing and the at least one pressing means is located in the connector housing.

8. A cable connector arrangement as claimed in claim 6, wherein, the connector housing has an interior, the at least one pressing means is formed in one piece with the connector housing and the at least one pressing means comprises a rib that projects into the interior of the connector housing.

9. A cable connector arrangement as claimed in claim 8, wherein the at least one pressing means comprises a rib that projects into the interior of the connector housing.

10. A cable connector arrangement as claimed in claim 6, wherein the at least one pressing means is formed independently of the connector housing and the at least one pressing means comprises a clamp.

11. A cable connector arrangement as claimed in claim 6, wherein the connector housing has a central axis and the at least one pressing means guides the two individual lines through the central section along the central axis.

12. A cable connector as claimed in claim 6, wherein the rear section extends along the connector housing.

13. A cable connector as claimed in claim 6, wherein at least one of: (i) the connector housing and (ii) the pressing means is formed to minimize air inclusions in the central section.

14. A cable connector arrangement as claimed in claim 6, wherein the connector housing has at least one lower shell and one upper shell.

15. A cable connector as claimed in claim 6, wherein the connector housing has at least one fastening means for fixing the cable sheath axially to provide strain relief of the cable.

16. A cable connector arrangement as claimed in claim 6, further comprising a plurality of contact elements located in the connector housing, the contact elements being electrically connected to the respective electrical conductors of the respective individual lines.

17. A cable connector arrangement as claimed in claim 1, wherein the front section has at least one separating means for separating the contact elements from one another.

18. A cable connector for connecting a mating connector with an electrical cable of a type having a cable sheath, at least two individual lines, each of the individual lines having a respective insulation and an a respective electrical conductor, the cable connector comprising:

a front section configured for connection to the mating connector;

a rear section within which the individual lines are surrounded by the cable sheath of the electrical cable; and a central section interposed longitudinally between the front section and the rear section;

the electrical conductors of two of the individual lines having respective cross-sectional center-points which are mutually spaced from one another by a mutual distance;

in the rear section the mutual distance being a first mutual nominal distance, in the front section the mutual distance being a second mutual distance, the second distance being greater than the first mutual nominal distance; the central section having at least one pressing means which influences an impedance of the cable connector by pressing the respective insulations of both of the two individual lines against one another to compress the respective insulations of both of the two individual lines causing the respective insulations of both of the two individual lines to be mechanically deformed an area in which the respective insulations of the two individual lines are in common contact with one another, the area being located within the central section, the respective insulations of the two individual lines being mechanically deformed in a way which results in the mutual distance in the area being a third mutual distance which is less than the first mutual nominal distance.

19. A cable connector as claimed in claim 18, wherein the cable connector further includes a connector housing and wherein the rear section, the central section and the front section are housed in the connector housing.

* * * * *